US008794740B2

(12) United States Patent
Hamano

(10) Patent No.: US 8,794,740 B2
(45) Date of Patent: Aug. 5, 2014

(54) INK JET RECORDING APPARATUS

(75) Inventor: Tetsu Hamano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/587,085

(22) Filed: Aug. 16, 2012

(65) Prior Publication Data

US 2013/0044159 A1 Feb. 21, 2013

(30) Foreign Application Priority Data

Aug. 19, 2011 (JP) ..... 2011-179608

(51) Int. Cl.
*B41J 2/165* (2006.01)

(52) U.S. Cl.
CPC ..... *B41J 2/16535* (2013.01); *B41J 2/16547* (2013.01); *B41J 2002/16576* (2013.01)
USPC ..... 347/33

(58) Field of Classification Search
USPC ..... 347/33
See application file for complete search history.

(56) References Cited

U.S. PATENT DOCUMENTS

| | | | | |
|---|---|---|---|---|
| 7,686,420 | B2 | 3/2010 | Inoue | |
| 2002/0122092 | A1 * | 9/2002 | Okamura et al. | 347/33 |
| 2002/0126178 | A1 * | 9/2002 | Toh et al. | 347/33 |
| 2005/0259126 | A1 * | 11/2005 | Tanaka et al. | 347/33 |
| 2006/0256155 | A1 * | 11/2006 | Inoue et al. | 347/33 |
| 2009/0309919 | A1 * | 12/2009 | Suzuki | 347/33 |
| 2011/0316928 | A1 * | 12/2011 | Roth et al. | 347/33 |

FOREIGN PATENT DOCUMENTS

JP 2004-90550 A 3/2004

* cited by examiner

*Primary Examiner* — Shelby Fidler
(74) *Attorney, Agent, or Firm* — Canon USA Inc IP Division

(57) ABSTRACT

An inkjet recording apparatus includes a carriage with a recording head, a wiper holder that holds a wiper to wipe a discharge port surface of the recording head, a latch member arranged on the wiper holder that moves between a latch position where the wiper holder is held at a wiping position and a release position where the wiper holder is released, and a latch release member that moves the latch member from the latch position to the release position.

9 Claims, 10 Drawing Sheets

INK JET RECORDING APPARATUS

BACKGROUND OF THE INVENTION

1. Field of the Invention

The present invention relates to an inkjet recording apparatus configured to perform recording by discharging ink onto a recording material from a recording head.

2. Description of the Related Art

A recovery mechanism unit functions such that the recording head is recovered to maintain a recording quality in a normal condition by eliminating a clogging in the recording head which discharges ink. The recovery mechanism unit includes a pump mechanism for sucking or discharging ink from a discharge port, a capping mechanism for covering the discharge port by bringing a cap into contact with the recording head, and a wiping mechanism for wiping the surface of the discharge port by rubbing the surface with a wiper. The configuration of a conventional recovery mechanism unit includes a slider capable of moving only within a predetermined area driven by a movement of a carriage including the recording head. The slider includes the caps and the wipers.

U.S. Pat. No. 7,686,420 discusses a technique in which an approach amount of the wiper with respect to the recording head can be attained at a high precision by restricting a position in height of the slider including the wiper, with only a lock lever (latch unit). However, when the carriage moves toward the slider and the lock lever for latching the slider is activated, a wiping action is always performed when the carriage is reversed. For example, the wiping action is always performed when the cap is opened.

However, like in a case where a recording action is repeated after a short rest time following a previous recording action, sometimes, the wiping action is unnecessary when opening the cap. Performing unnecessary wiping actions results in degradation of wiper durability. Additionally, after the wiping action, a preliminary discharge action for avoiding mixing of different ink colors is necessary, thereby increasing the amount of unnecessary inks being discarded.

Japanese Patent Application Laid-Open No. 2004-90550 discusses a technique in which the operation position of the lock lever (cap slider latch unit) is arranged outside the capping position with respect to a recording area in which recording is performed. Consequently, when the wiping action is unnecessary after the capping action, the carriage can be moved into the recording area without being moved outside the capping position, so that the cap opening action can be performed without performing wiping action. Thus, an apparatus is configured to select whether the wiping action is performed. However, this leads to newly setting a wiper action changeover position, which results in increasing the width of the recording apparatus.

SUMMARY OF THE INVENTION

An aspect of the present invention is directed to providing an ink jet recording apparatus which, in a configuration for executing a wiping action by moving a carriage, inhibits any unnecessary wiping action from executing by selectively changing whether the wiping action is performed.

According to an aspect of the present invention, an inkjet recording apparatus includes a carriage that includes a recording head to perform recording in a recording area, a wiper holder that holds a wiper to wipe a discharge port surface of the recording head and that moves following a movement of the carriage, wherein the wiper holder moves to a wiping position where the discharge port surface is allowed to be wiped and a retraction position where the discharge port surface is not allowed to be wiped, a latch member arranged on the wiper holder and that moves between a latch position where the wiper holder is held at the wiping position and a release position where the wiper holder is released from a latch state, an engagement unit that, when the carriage moves from the recording area to a first position, engages with the latch member that has moved to the latch position, and a latch release member that, when the carriage moves from the recording area to a second position beyond the first position, moves the latch member from the latch position to the release position.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspect of the invention and, together with the description, serve to explain the principles of the invention.

DESCRIPTION OF THE EMBODIMENTS

Figure 1:
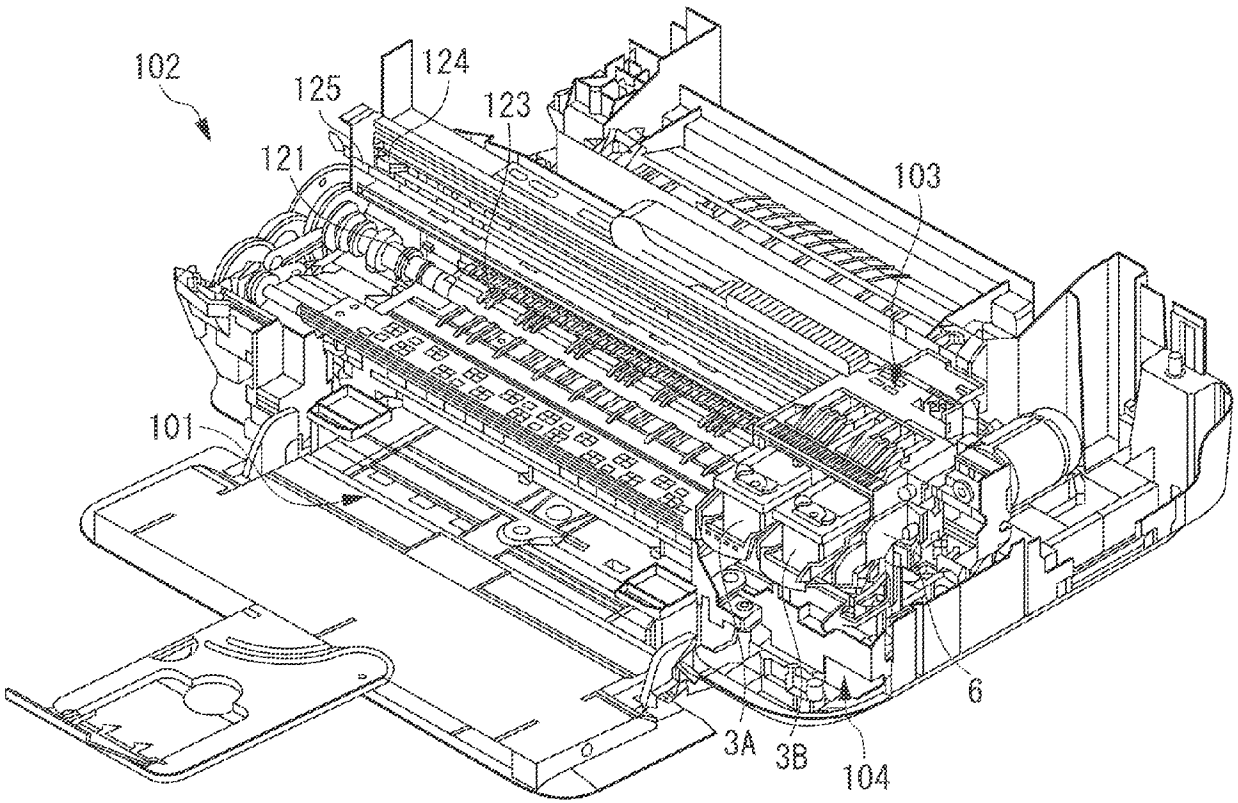
FIG. 1 is a perspective view illustrating an ink jet recording apparatus.

Various exemplary embodiments, features, and aspects of the invention will be described in detail below with reference to the drawings.

Similar reference numerals in the respective drawings indicate similar or corresponding components. When indicating a plurality of identical components or portions by adding a symbol to similar reference numeral, all those components or an arbitrary component is expressed with only the reference numeral without any symbol.

FIG. 1 is a perspective view illustrating the ink jet recording apparatus according to the present exemplary embodiment. As illustrated in FIG. 1, the ink jet recording apparatus includes a paper feeding unit 101, a conveyance unit 102, a recording mechanism unit 103, and a recovery mechanism unit 104. The paper feeding unit 101 feeds a recording material such as a recording paper into the apparatus main body. The conveyance unit 102 conveys the recording material supplied from the paper feeding unit. The recording mechanism unit 103 records an image on the recording material based on image information. The recovery mechanism unit 104 performs a recovery action for maintaining an ink discharge performance of a recording head to ensure the quality of a recorded image.

The recording materials stacked on the paper feeding unit 101 are separated one by one and sent out by a paper feeding roller, which is driven by a feeding motor (not illustrated), and fed to the conveyance unit 102. After being fed to the conveyance unit 102, the recording material is nipped by a conveyance roller 121, which is driven by a conveyance motor (not illustrated), and a pinch roller 122, and conveyed through a recording unit. In the recording unit, recording onto the recording material is performed by the recording mechanism unit 103. The recording head loaded on the carriage 6, which moves in a main scanning direction, is driven based on image information and ink is discharged from a discharge port of the recording head to perform recording. The recorded recording material is nipped between a discharge roller that is driven synchronously with the conveyance roller 121 and a spur that is pressed by the discharge roller, and discharged out of the apparatus main body.

The recording mechanism unit 103 includes a carriage 6, which reciprocates in the main scanning direction and recording cartridges 3A, 3B are loaded onto the carriage 6. The carriage 6 is guided and supported so that the carriage 6 can reciprocate along a guide shaft and a guide rail provided in the apparatus main body. During a recording action of recording onto a recording material, the carriage 6 reciprocates in a recording area via a carriage belt 124, which is driven by a carriage motor. The carriage 6 is controlled by detecting a position and a velocity of the carriage 6 with an encoder sensor loaded on the carriage 6 and an encoder scale 125 stretched on the apparatus main body. By repeating a recording action of the recording head, carried out synchronously with a movement (main scan) of the carriage 6, and conveyance (sub scan) of the recording material, carried out every predetermined pitch, the recording of an entire recording material is performed.

By eliminating a clogging on the discharge port of the recording heads 5A and 5B, the recovery mechanism unit 104 recovers the function of the recording heads 5A and 5B to maintain the quality of a recorded image in a normal condition. The recovery mechanism unit 104 includes a capping mechanism for covering the discharge port, a suction mechanism such as a pump, for sucking ink from the discharge port, and a wiping mechanism for wiping the surface of the discharge port. The recovery mechanism unit 104 of the present embodiment includes a slider 7 which, when the carriage 6 moves toward the recovery mechanism unit 104, is slidable within a predetermined area while being driven by a movement of the carriage 6. The slider 7 is loaded with caps 1A and 1B of the capping mechanism and wipers 8 and 9 of the wiping mechanism, and functions as a wiper holder.

Figure 2:
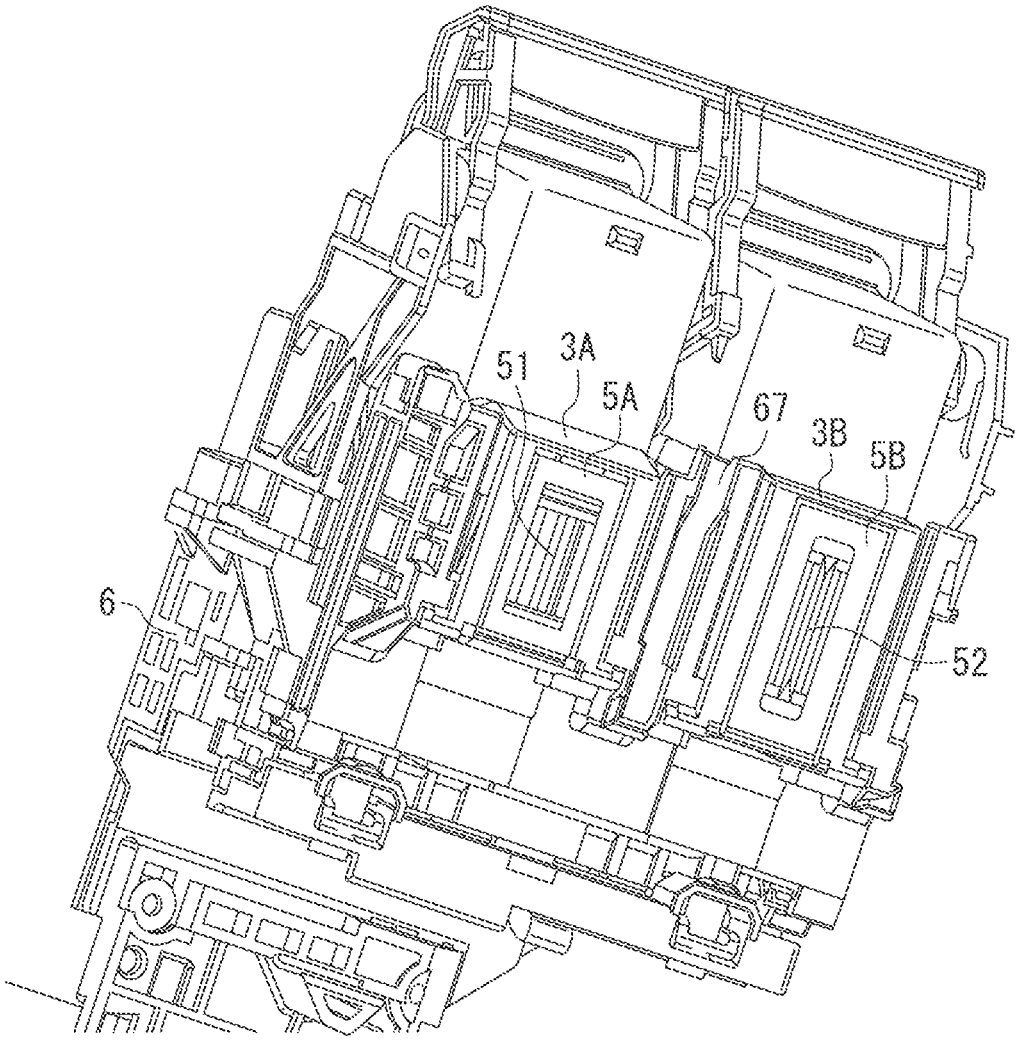
FIG. 2 is a perspective view illustrating a recording mechanism unit as viewed from below.

FIG. 2 is a perspective view illustrating the recording mechanism unit 103 as seen from below. Two recording cartridges 3A and 3B are loaded onto the carriage 6. Each of the recording cartridges 3A and 3B include an ink cartridge in which the recording heads 5A and 5B and an ink tank are integrated. The recording cartridge 3A for color contains the recording head 5A for recording with inks of a plurality of colors. The recording cartridge 3B for a single color contains the recording head 5B for recording with an ink of a single color (e.g., black). An array of discharge ports for discharging three color inks, for example, cyan, magenta and yellow, are formed on a discharge port surface 51. An array of discharge ports for discharging ink of a single color such as black is formed on a discharge port surface 52 of the recording head 5B.

Figure 3:
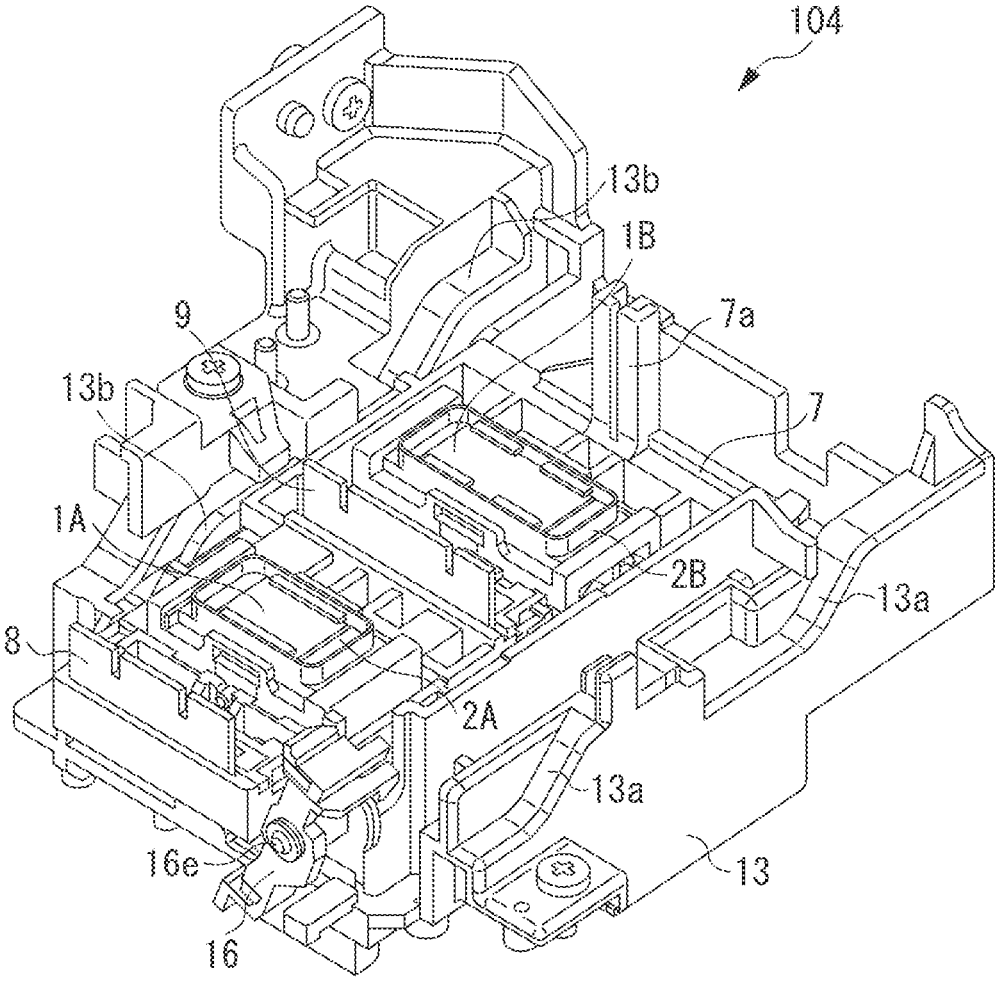
FIG. 3 is a perspective view illustrating a recovery mechanism unit.

FIG. 3 is a perspective view illustrating the recovery mechanism unit 104. The capping mechanism including caps 1A and 1B for covering the discharge port surfaces 51 and 52 and wipers 8 and 9 for wiping the discharge port surfaces 51 and 52 are loaded on the slider 7 that serves as a wiper holder.

An abutting portion 7*a* is provided on a right end portion of the slider 7 that the side face of the carriage 6 can abut on when the carriage 6 moves toward the slider 7. The slider 7 moves between a wiping position, where the wiper is allowed to wipe the recording head, and a wiper retraction position, where the wiper is allowed to be apart from the recording head.

The slider 7 moves within the predetermined area while being driven by a movement of the carriage 6 when the carriage 6 moves toward the recovery mechanism unit 104. The slider 7 moves along a cam face of each of slider cams 13*a* and 13*b* provided on a slider base unit 13. Consequently, the slider 7 is controlled at a predetermined height with respect to the discharge port surfaces 51 and 52 at each position (capping position, wiping trigger position, wiping position, wiper retraction position, etc.) along a movement direction of the carriage 6.

Figure 4:
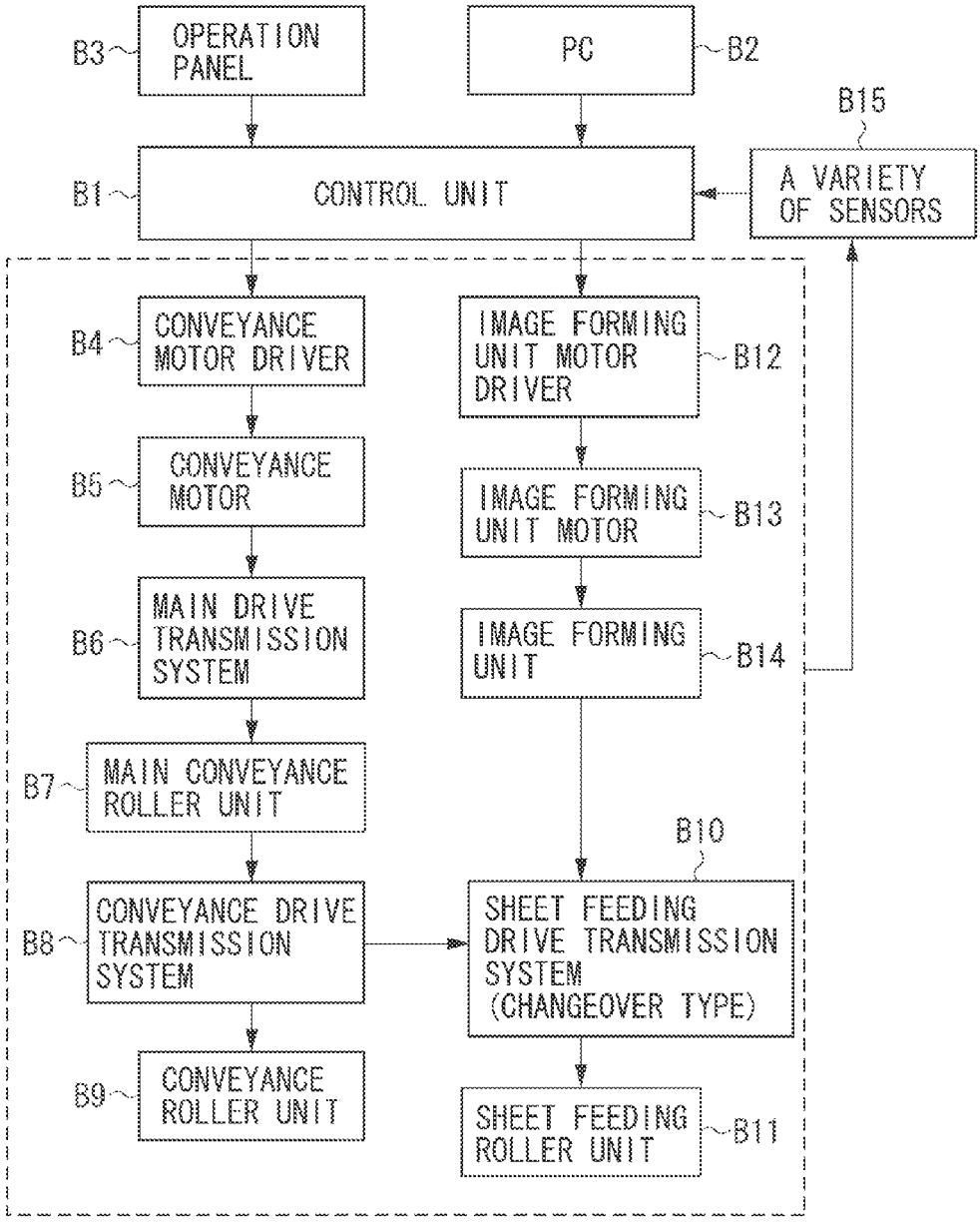
FIG. 4 is a block diagram illustrating an outline of a recording action of the ink jet recording apparatus.

FIG. 4 is a block diagram illustrating an outline of the recording action of the ink jet recording apparatus. A control unit B1 processes a variety of signals. A recording action instruction is transmitted from a personal computer (PC) (B2) connected to an interface unit of the control unit B1 or an operation panel B3 provided in the apparatus main body. When a recording action instruction is transmitted to the control unit B1, or a timer or the like incorporated in the control unit B1 performing the recording action with, the control unit B1 issues an instruction, via a conveyance motor driver B4, to supply the conveyance motor B5 with electricity. At the same time as this instruction, the control unit B1 issues an instruction, via an image forming unit motor driver B12, to supply an image forming unit motor B13 with electricity. A main drive transmission system B6 is connected to the conveyance motor B5, and the conveyance motor B5 drives a main conveyance roller unit B7 for mainly conveying the recording material at the time of recording action. A conveyance drive transmission system B8 is connected to the main conveyance roller unit B7 and drives a conveyance roller unit B9 for conveying the recording material.

An image forming unit B14 is connected to the image forming unit motor B13. When the image forming unit motor B13 is driven, the image forming unit B14 performs a recording action. Further, the image forming unit B14 performs an action of a paper feeding drive transmission system B10 for activating a sheet feeding roller unit B11, which separates the stacked recording materials, and feeds the sheets one by one, in cooperation with a conveyance action of the conveyance drive transmission system B8. The action of the sheet feeding drive transmission system B10 switches between supplying and not supplying electricity to the sheet feeding roller unit B11, and selectively changes between both statuses depending on each of a variety of timings. Consequently, synchronous drive/asynchronous drive between the sheet feeding roller unit B11 and the conveyance roller unit B9 can be performed.

A rotation condition and load condition of each motor and a conveyance condition of each recording material are detected by a variety of sensors B15 provided on each position of the recording apparatus, and information is sent to the control unit B1 in the form of a signal. The control unit B1 controls each motor based on an instruction and the sensor information to perform the recording.

Figure 5:
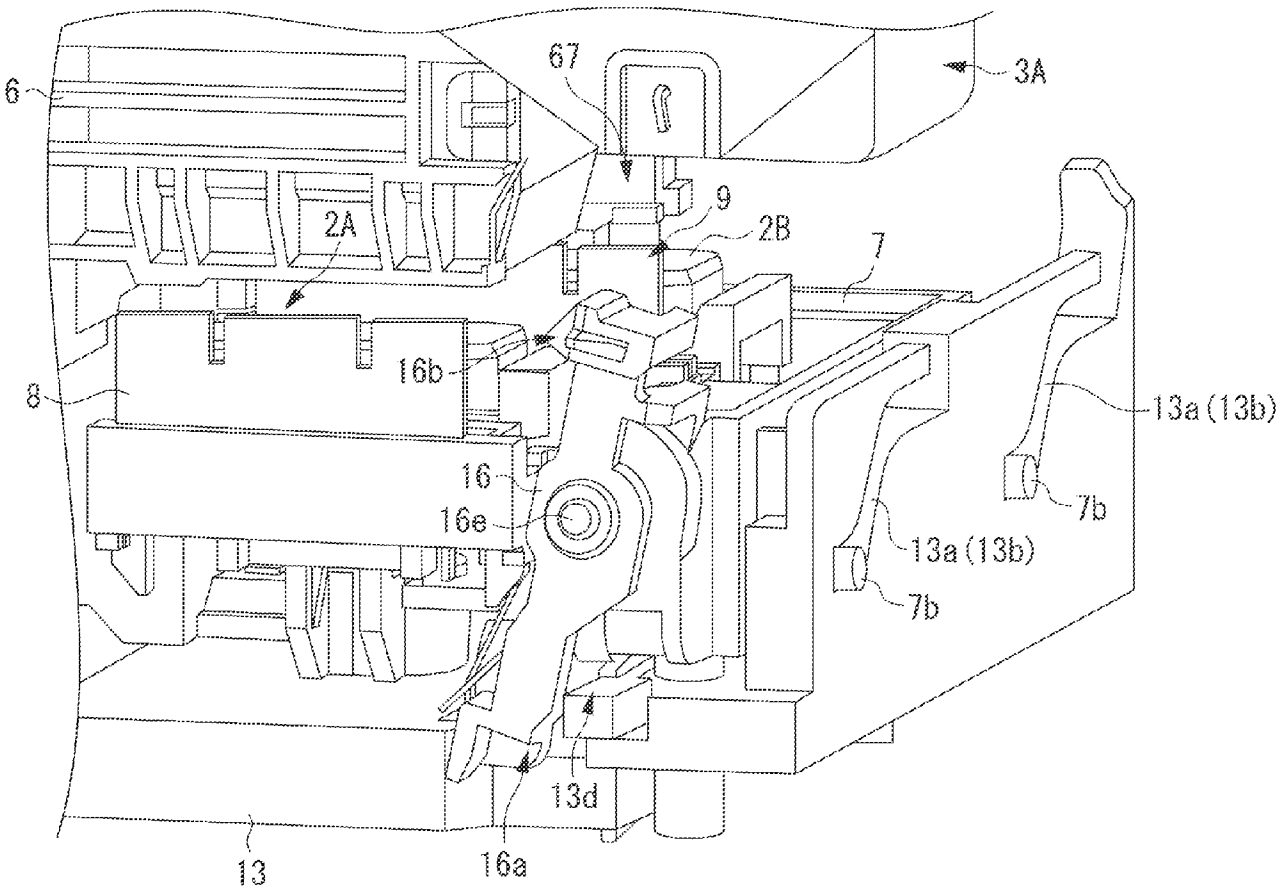
FIG. 5 is a perspective view illustrating a state in which the slider is located at a wiper retracting position.
Figure 6:
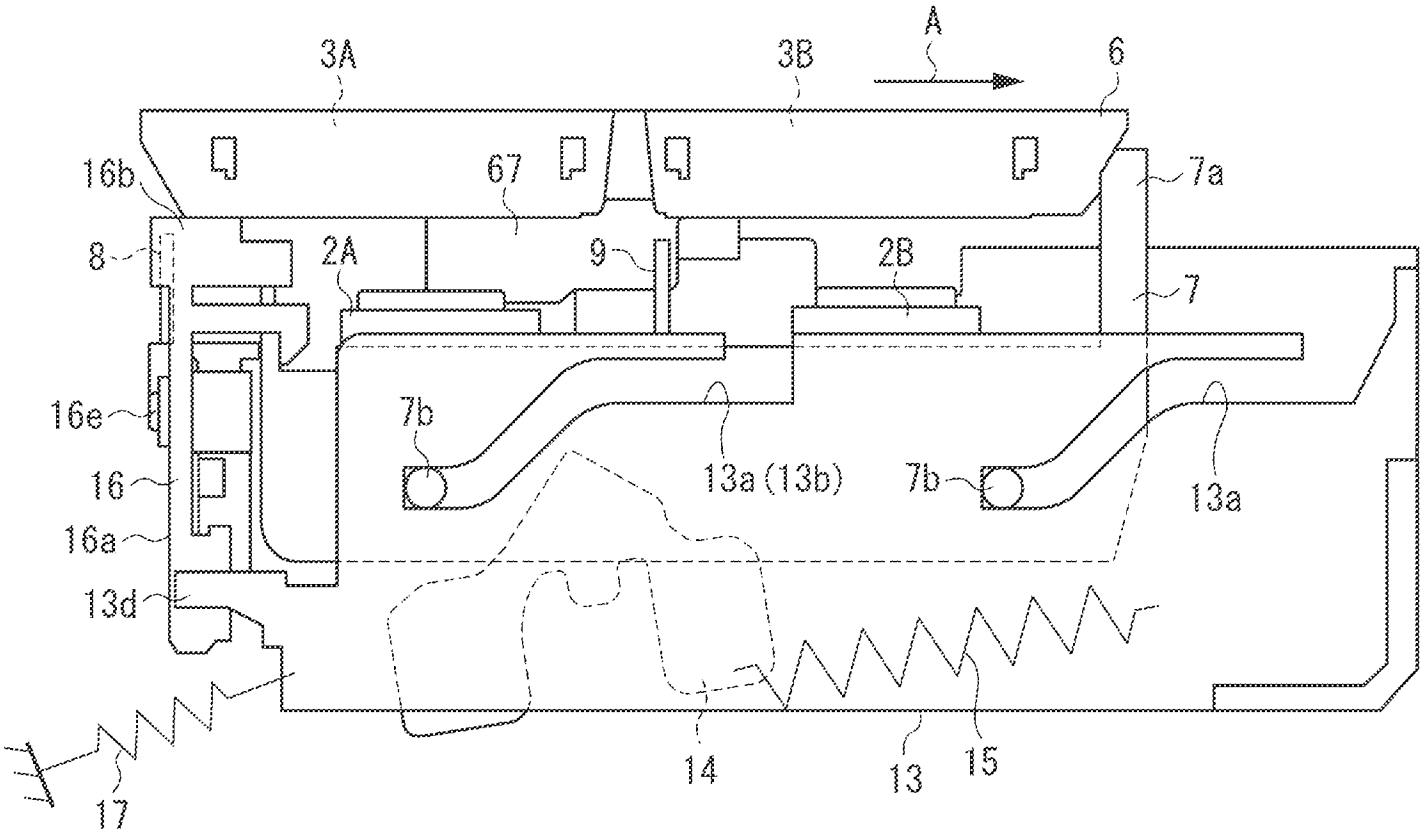
FIG. 6 is a partially broken front view illustrating a state in which the slider is located at the wiper retracting position.

Next, the recovery mechanism unit 104 of the present embodiment will be described. FIG. 5 is a perspective view illustrating a state in which the slider is located at a wiper retraction position. FIG. 6 is a partially broken front view illustrating the state in which the slider is located at the wiper retraction position.

As illustrated in FIG. 3, the caps 1A and 1B for capping the discharge ports 51 and 52 are held by cap holders 2A and 2B. The respective cap holders 2A and 2B are mounted on the slider 7 with two claw portions. A cap spring is attached between the cap holders 2A and 2B and the slider 7, so that the caps 1A and 1B and the cap holders 2A and 2B are urged upward by the cap springs. The caps 1A and 1B are arranged at a predetermined gap in a movement direction of the carriage 6. The first wiper 8 is arranged at an end portion of the recording area in which the carriage 6 reciprocates to wipe the discharge port surface 51 of the color recording head 5A. The second wiper 9 is arranged between the caps 1A and 1B to wipe the discharge port surface 52 of the black recording head 5B. As illustrated in FIG. 5, the slider moves to the wiping positions, so that the approach amount of each of the wipers 8 and 9 into the recording heads 5A and 5B is controlled at a high precision.

The interior of the caps 1A and 1B is connected to the suction pump (not illustrated) which serves as a negative pressure generation mechanism via a tube (not illustrated). By activating the suction pump with the discharge port of the recording heads 5A and 5B capped with the cap 1, a negative pressure is generated within the cap 1, so that the ink is sucked through the discharge port of the recording heads 5A 5B by the negative pressure. By discharging bubbles in the ink, firmly fixed ink and the like from an ink flow path of the recording heads 5A and 5B by such a suction action, the recording heads 5A and 5B can maintain ink discharge performance.

As illustrated in FIGS. 5 and 6, rod-like projection portions (or shaft portions) 7*b* are provided at four positions on both side faces of the slider 7 such that they laterally project. The projection portions 7*b* at the four positions abut on each of cam faces of the slider cams 13*a* and 13*b* provided in the slider base unit 13. As illustrated in FIG. 6, the slider 7 is urged obliquely downward toward the recording area by a slider spring (pulling spring) 17 stretched between the slider base portion 13 and the slider 7. Therefore, the slider 7 is movably mounted with the projection portions 7*b* abutting on the cam faces of the slider cams 13*a* and 13*b* by the urging force of the slider spring 17.

As illustrated in FIG. 3, a lock lever 16 serving as a latch unit for locking (latching) the slider 7 at a wiping position is provided on the slider 7, the lock lever 16 being located in the downstream of the conveyance direction at an side end portion of the recording area. The lock lever 16 is rotatably provided to rotate between a latch position, where the slider 7 is latched at a wiping position and a release position, where the slider 7 is released from the latch state.

When the slider 7 moves to a wiping trigger position described later, the lock lever 16 latches the slider 7 to the slider base portion 13 to restrict a position of the slider 7. The lock lever 16 is provided rotatable in a plane perpendicular to (intersecting with) the movement direction of the carriage 6. The lock lever 16 is rotatably supported at its central portion by a supporting shaft 16*e*. The lock lever 16 is urged with a spring force between the lock lever 16 and the supporting shaft 16*e* in a radial direction or a thrust direction, so that the lock lever 16 is supported to be rotatable under a predetermined friction force. As long as no external force torque than a predetermined value is applied, the lock lever 16 is held at a rotation position displaced by an external force or the like.

The slider base unit 13 is provided with a lock face 13*d* in which a bottom end portion 16*a* of the lock lever 16 can latch when the longitudinal direction of the lock lever 16 turns substantially parallel to the perpendicular direction (hereinafter, vertical orientation). An unlocking projection portion 67 for releasing an engagement state between the bottom end portion 16*a* of the lock lever 16 and the lock face 13*d* is provided on the bottom of the carriage 6.

When the carriage 6 moves toward the recording area, the unlocking projection portion 67 abuts on a top end portion 16*b* of the lock lever 16 held at a latch position (vertical orientation) to rotate the lock lever 16 clockwise. Consequently, the latch state between the bottom end portion 16*a* of the lock lever 16 and the lock face 13*d* is released. Further, the slider base unit 13 is provided with a latch release guide portion 13*e* (see FIGS. 7 and 9) serving as a restriction unit for restricting the lock lever 16 located at a retraction position from being rotated to the latch position when the slider 7 has been moved to a wiping position.

The slider base unit 13 is provided with a latch release cam 14 (see FIGS. 6, 8, and 10) serving as a cam member, included in a wiper holder latch release unit for releasing the locking state (wiper locking) of the slider 7 locked at the wiping position. The latch release cam 14 is supported on the slider base unit 13 such that the latch release cam 14 can swing. The latch release cam 14 is urged by a cam spring 15 serving as an urging member included in the wiper holder latch release unit. The cam spring 15 urges the latch release cam 14 to rotate the lock lever 16 to the release position when the lock lever 16 abuts on the latch release cam 14. Specifically, when the bottom end portion 16*a* of the lock lever 16 abuts on the latch release cam 14, the latch release cam 14 rotates the lock lever 16 held in the vertical orientation by the urging force of the spring clockwise in FIG. 10. When the slider 7 is moved to the recording area with this status, the bottom end portion 16*a* of the lock lever 16 is guided to the latch release guide portion 13*e* provided on the slider base unit 13, and brought back to the wiper retraction position without performing wiping action.

Figure 7:
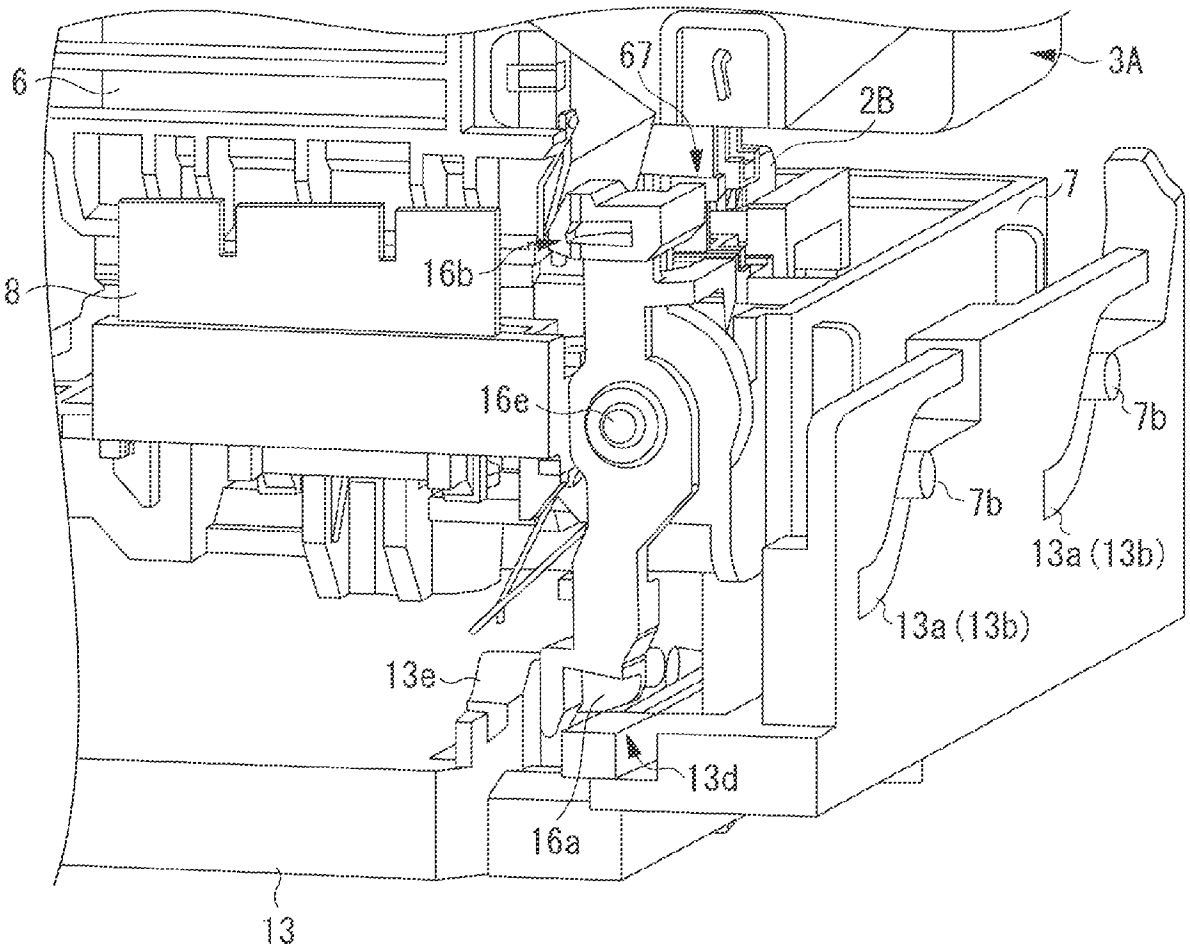
FIG. 7 is a perspective view illustrating a state in which the slider has been moved to a wiping trigger position.
Figure 8:
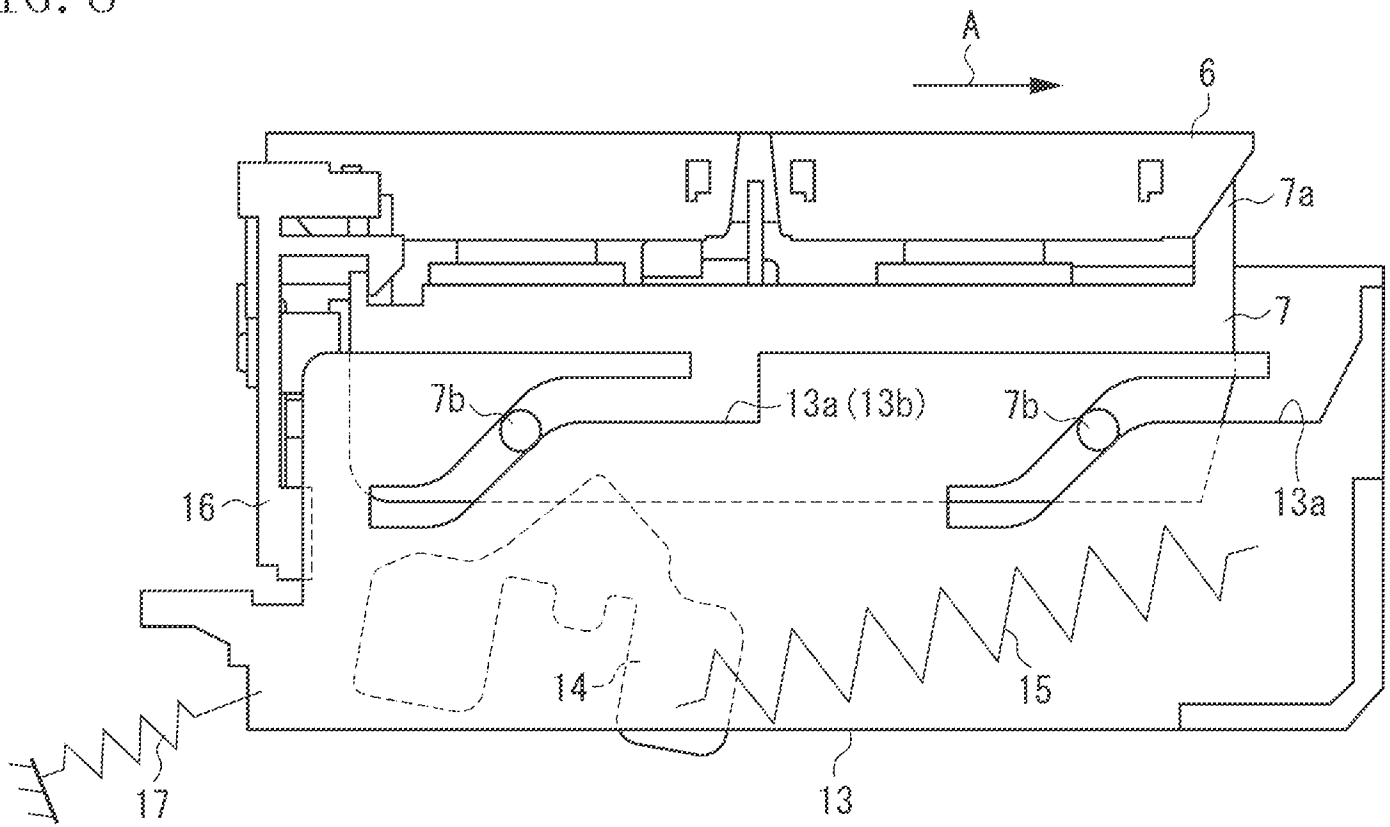
FIG. 8 is a partially broken front view illustrating a state in which the slider has been moved to a wiping trigger position.

Next, an operation accompanying the wiping action will be described. FIG. 7 is a perspective view illustrating a state in which the slider has been moved to a wiping trigger position. FIG. 8 is a partially broken front view illustrating a state in which the slider has been moved to the wiping trigger position. When the carriage 6 has not been moved to the capping position of the recovery mechanism unit 104 during a recording action, the lock lever 16 is located at a release position (inclined orientation), in which the lock lever has been rotated clockwise from the vertical orientation (see FIG. 5).

When the carriage 6 moves toward the recovery mechanism unit 104 from the recording area, the side face of the carriage 6 abuts on the abutting portion 7*a* of the slider 7. Consequently, the slider 7 is driven by the carriage 6 and moves, together with the carriage 6, in a direction of an arrow A indicated in FIG. 6. As the slider 7 moves in the direction of the arrow A, the slider 7 ascends along the cam faces of the slider cams 13*a* and 13*b*.

As the slider 7 moves, the lock lever 16 is rotated counterclockwise in FIG. 5 by a pressing force generated by the urging force of the spring. Then, the lock lever 16 is held in the vertical orientation in which the bottom end 16*a* can be latched (locked) on the lock face 13*d* of the slider base unit 13 by the aforementioned friction force.

Subsequently, the movement direction of the carriage 6 is reversed before the lock lever 16 abuts on the latch release cam 14. A position where the carriage is reversed before the lock lever 16 abuts on the latch release cam 14 is called wiping trigger position. When the movement direction of the carriage 6 is reversed, the slider 7 moves along the slider cams 13*a* and 13*b* by the urging force of the slider spring 17 and begin to descend. When the slider 7 has moved to a position where the slider 7 descends by a predetermined amount, the bottom end portion 16*a* of the lock lever 16 held at the latch position, where the lock lever 16 is in the vertical orientation by the friction force, is allowed to abut on the lock face 13*d* of the slider base unit 13. Consequently, the slider 7 stops at the wiping position, so that the slider 7 is locked at the wiping position by the lock lever 16. As the carriage 6 moves further toward the recording area from the wiping position, the carriage 6 leaves the slider 7.

When the carriage 6 moves further toward the recording area, the wipers 8 and 9 loaded on the slider 7 rubs the discharge port surfaces 51 and 52 of the recording heads 5A and 5B, loaded on the carriage 6, to perform the wiping action. A color recording head 5A is wiped by a first wiper 8, and a black recording head 5B is wiped by a second wiper 9.

The carriage 6 further moves toward the recording area, so that the discharge port surfaces 51 and 52 pass the two wipers 8 and 9. After that, the projection portion 67 for unlocking provided on the bottom of the carriage 6 presses the top end portion 16*b* of the lock lever 16. As a result, the lock lever 16 is pressed by the projection portion 67, so that the lock lever 16 is rotated clockwise around the supporting shaft 16*e* as a center. Thus, the bottom end portion 16*a* of the lock lever 16 leaves the lock face 13*d* of the slider base unit 13, and the slider 7 is unlocked by the lock lever 16. The slider 7 unlocked by the lock lever 16 is moved up to the bottommost portion of the slider cams 13*a* and 13*b* near the recording area by an urging force of the slider 17, so that the slider 7 is returned to the wiper retraction position indicated in FIGS. 5 and 6.

Figure 9:
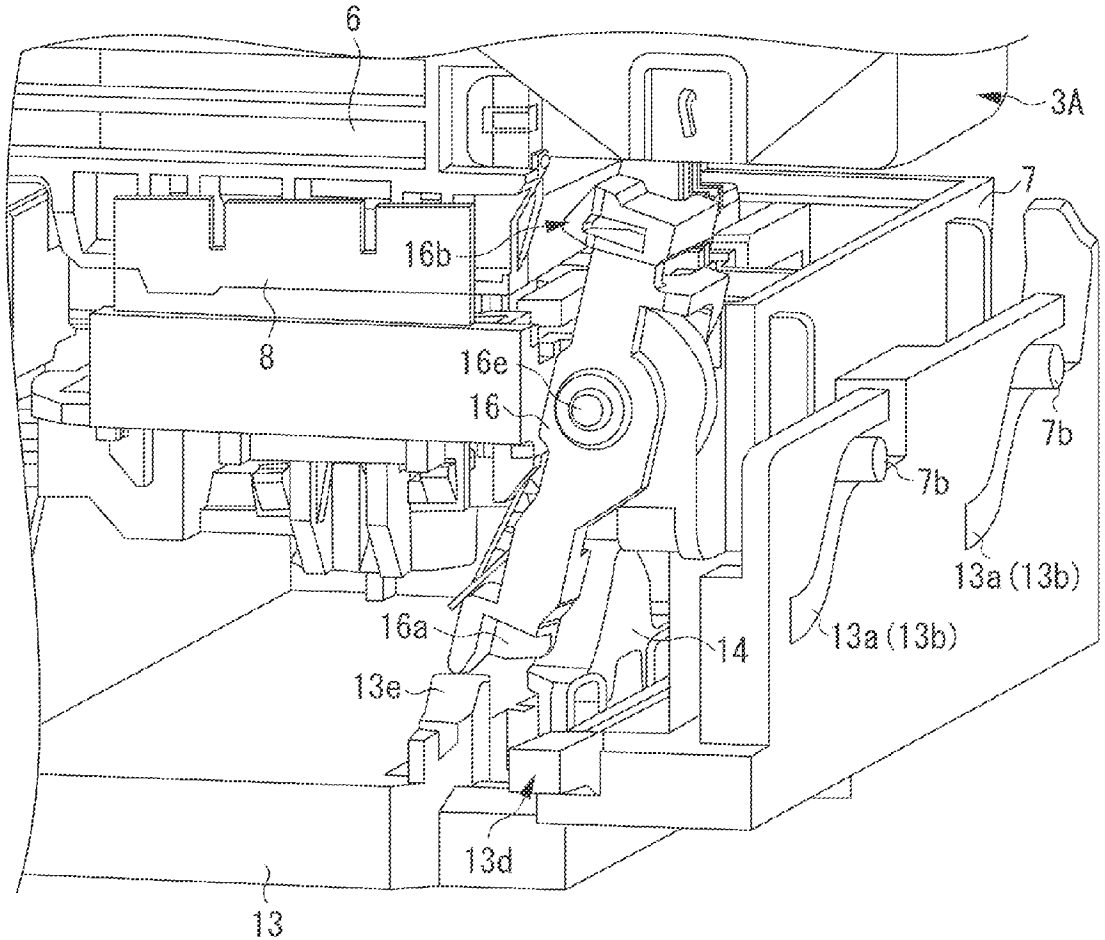
FIG. 9 is a perspective view illustrating a state in which the slider is moving toward a capping position.
Figure 10:
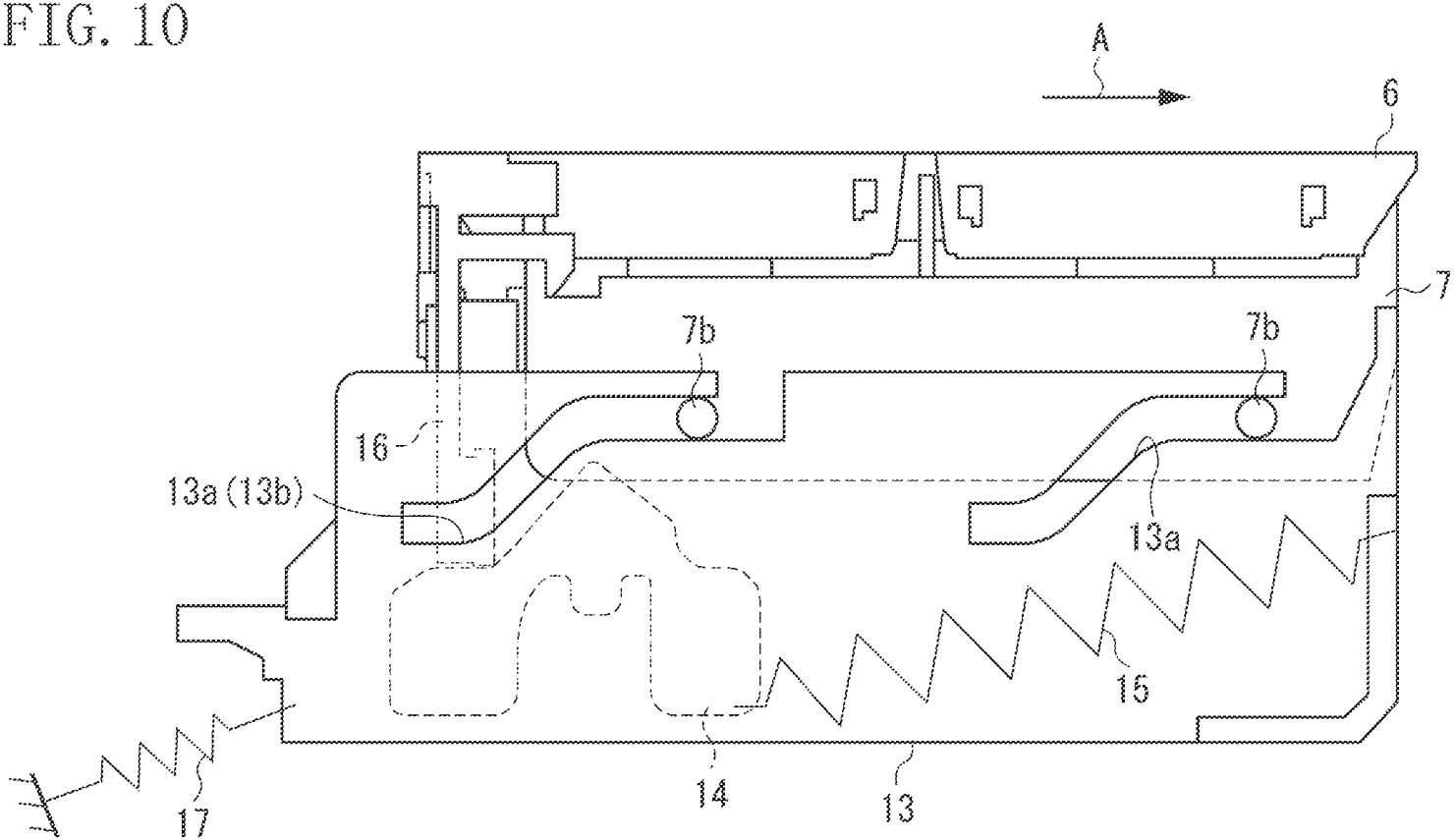
FIG. 10 is a partially broken perspective view illustrating a state in which the slider has been moved to the capping position.

Next, an operation accompanying no wiping action will be described. FIG. 9 is a perspective view illustrating a state in which the slider is moving toward the capping position. FIG. 10 is a partially broken perspective view illustrating a state in which the slider has been moved to the capping position. When, as illustrated in FIG. 9, the carriage 6 moves deeper than the aforementioned wiping trigger position with respect to the recording area, the lock lever 16 of the slider 7 abuts on the latch release cam 14. When the carriage 6 moves further in the direction of the arrow A, the lock lever 16 is rotated clockwise in FIG. 5 by a pressing force of the latch release cam 14 urged by the cam spring 15. The lock lever 16 is rotated, so that the bottom end portion 16*a* is located at the release position away from the lock surface 13*d*.

When the slider 7 moves further in the direction of the arrow A together with the carriage 6 and reaches a topmost position (capping position), the caps 1A and 1B on the slider 7 are pressed against the discharge port surfaces 51 and 52 of the recording heads 5A and 5B, to create a capping state of covering the discharge ports. At this time, the lock lever 16 is pressed by the latch release cam 14 to maintain the release status. Further, when the slider 7 moves further in the direction of the arrow A than the capping position also, the release status of the lock lever 16 is maintained.

Then, the movement direction of the carriage 6 is reversed at the capping position and the carriage 6 begins to move toward the recording area. When the movement direction of the carriage 6 is reversed, the slider 7 moves along the slider cams 13*a*, 13*b* by the urging force of the slider spring 17 and begins to descend. The lock lever 16 is carried over to the latch release guide portion 13*e* of the slider base unit 13 while being kept in the release status in which the lock lever 16 is pressed by the latch release cam 14.

When the slider 7 is moved to the wiping position as the carriage 6 moves further toward the recording area, the lock lever 16 is restricted from being rotated to the latch position by the latch release guide portion 13*e*. Thus, when the slider 7 is moved to the wiping position, the slider 7 passes the wiping position without being latched (wiper locked) at the wiping position.

Finally, the lock lever 16 returns to the wiper retraction position indicated in FIG. 5 by passing through a different path from the operation accompanying the wiping action as illustrated in FIG. 10.

As described above, the present embodiment includes the latch release cam 14 and cam spring 15 which, when the slider is moved from the wiping position in the direction of the arrow A to leave the recording area, rotate the lock lever 16 which has locked the slider 7 at the wiping position, to the release position. Consequently, whether the wiping action is performed can be selected, thereby controlling the wiping action easily at an optimum timing.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-179608 filed Aug. 19, 2011, which is hereby incorporated by reference herein in its entirety.

What is claimed is:

1. An inkjet recording apparatus comprising:

a carriage configured to mount a recording head to perform recording in a recording area;

a wiper holder configured to hold a wiper to wipe a discharge port surface of the recording head and that moves following a movement of the carriage, wherein the wiper holder moves to a wiping position where the discharge port surface is allowed to be wiped and a retraction position where the discharge port surface is not allowed to be wiped;

a latch unit configured to move between a latch position where the wiper holder is held at the wiping position and a release position where the wiper holder is not held at the wiping position, wherein the latch unit moves to the latch position when the carriage moves from the recording area to a first position; and a latch release unit configured to move the latch unit from the latch position to the release position when the carriage moves to a second position further from the recording area than the first position.

2. An inkjet recording apparatus according to claim 1, wherein the wiper holder is a slider that slides with abutting on the carriage.

3. An inkjet recording apparatus according to claim 1, wherein the latch unit rotates between the latch position and the release position within a plane intersecting with a movement direction of the carriage.

4. An inkjet recording apparatus according to claim 3, further comprising an urging member that urges the latch unit so that the latch unit moves from the release position to the latch position.

5. An inkjet recording apparatus according to claim 1, wherein the latch release unit includes a cam member that moves the latch unit from the latch position to the release position and holds the latch unit at the release position.

6. An inkjet recording apparatus according to claim 5, further comprising an urging member that urges the cam member so that the latch unit moves from the latch position to the release position.

7. An inkjet recording apparatus according to claim 6, further comprising a restriction member that restricts the latch unit from moving from the release position to the latch position when the carriage moves from the second position to the recording area.

8. An inkjet recording apparatus according to claim 1, wherein the wiper holder includes a cap to cap the discharge port surface.

9. An inkjet recording apparatus according to claim 1, wherein the carriage includes a color recording head that discharges color ink and a black recording head that discharges black ink.

* * * * *